US011315470B2

(12) United States Patent
Bao

(10) Patent No.: US 11,315,470 B2
(45) Date of Patent: Apr. 26, 2022

(54) DISPLAY DEVICE AND DISPLAY METHOD THEREOF

(71) Applicant: TCL CHINA STAR OPTOELECTRONICS TECHNOLOGY CO., LTD., Guangdong (CN)

(72) Inventor: Yugang Bao, Guangdong (CN)

(73) Assignee: TCL CHINA STAR OPTOELECTRONICS TECHNOLOGY CO., LTD., Guangdong (CN)

( * ) Notice: Subject to any disclaimer, the term of this patent is extended or adjusted under 35 U.S.C. 154(b) by 280 days.

(21) Appl. No.: 16/624,440

(22) PCT Filed: Oct. 11, 2019

(86) PCT No.: PCT/CN2019/110578

§ 371 (c)(1),
(2) Date: Dec. 19, 2019

(87) PCT Pub. No.: WO2021/042444

PCT Pub. Date: Mar. 11, 2021

(65) Prior Publication Data

US 2021/0366348 A1 Nov. 25, 2021

(30) Foreign Application Priority Data

Sep. 5, 2019 (CN) ..... 201910834881.X

(51) Int. Cl.
*G09G 3/20* (2006.01)

(52) U.S. Cl.
CPC ... *G09G 3/2074* (2013.01); *G09G 2320/0271* (2013.01)

(58) Field of Classification Search
CPC ..... G09G 3/2003–2088
See application file for complete search history.

(56) References Cited

U.S. PATENT DOCUMENTS

2016/0343312 A1* 11/2016 Li ..... G09G 3/36
2020/0090604 A1* 3/2020 Chen ..... G09G 3/36

* cited by examiner

*Primary Examiner* — Hang Lin

(57) ABSTRACT

A display device and display method thereof are provided. The display device includes an image capture unit, a grayscale value capture unit, a grayscale value difference calculating unit, a grayscale difference threshold setting unit, and a pixel pattern output unit. In the display method of the present disclosure, weighted weight calculations managing different line types are correspondingly added, therefore, the color aliasing may be effectively avoided, and image features may be restored to the utmost.

10 Claims, 2 Drawing Sheets

DISPLAY DEVICE AND DISPLAY METHOD THEREOF

FIELD OF INVENTION

The present disclosure relates to the technical field of displays, and in particular, relates to a display device and display method thereof.

BACKGROUND OF INVENTION

In the technical field of displays, for a display device with RGBW sub-pixels arranged in strip-like pixels, a panel of four primary colors is realized by changing a white color filter on the basis of a conventional RGB panel of three primary colors. However, if RGBW sub-pixels used as a pixel unit replace the original RGB sub-pixels used as an pixel unit, the overall pixel resolution of the panel is reduced. Therefore, in order to maintain the image ratio and resolution of the original panel input, the visual resolution displayed by the panel is generally improved by sub-pixel multiplexing methods between adjacent pixels, that is, sub-pixel rendering technology.

Referring to FIG. 1, after the white sub-pixel W is introduced, the sub-pixel arrangement of the display device with RGB sub-pixels is compared to the conventional RGB sub-pixel arrangement, and the physical pixel resolution of the panel becomes three quarters of the original. The white sub-pixel W(n)' fine particles are shared by W(n−1) and W(n), and have a value of W(n)'=max(W(n−1), W(n)). However, the rendering of sub-pixels brings inevitable color aliasing problems. For panels with RGBW strip-like pixel arrangement, the vertical line images may be more serious mixed color images, resulting in blurred images. If a blue vertical line with white background is displayed, a magenta line may be subjectively seen. Mixing the spatial colors of the red and blue pixels results from insufficient sampling. Similarly, the phenomenon also occurs to similar line images.

As a result, it is necessary to provide an improved display device and display method thereof to solve the problems existing in the conventional technologies, as described above.

SUMMARY OF INVENTION

Technical Problem

An object of the present disclosure is to provide a display device and display method thereof, which can obtain vertical line feature information of images by detecting the input image. Weighted weight calculations managing different line types are correspondingly added, and, therefore, the color aliasing may be effectively avoided, and image features can be restored to the utmost.

Solution to Problem

To achieve the above object, the present disclosure provides a display method of a display device comprising steps of:

capturing original image data, wherein the original image data includes pixel units arranged in an array, each of the pixel units has i sub-pixels, and every i pixel units form a loop unit; capturing a grayscale value of a sub-pixel in each of the pixel units in one loop unit; capturing a grayscale value difference between any sub-pixel of one of the pixel units and the corresponding sub-pixel of another one of the pixel units, and capturing a maximum grayscale value difference from all of the sub-pixels of the pixel unit; and defining a grayscale difference threshold, and comparing, in one loop unit, all of the maximum grayscale value differences respectively with the grayscale difference threshold to obtain corresponding comparison results, wherein each of the comparison results corresponds to a pixel pattern.

Further, the step of capturing original image data includes:

inputting image data of a pixel unit having (i−1) sub-pixels; and converting the image data of the pixel unit having (i−1) sub-pixels into image data of a pixel unit having i sub-pixels to capture the original image data.

Further, the step of capturing a grayscale value difference between any sub-pixel of one of the pixel units and the corresponding sub-pixel of another one of the pixel units, and capturing a maximum grayscale value difference from all of the sub-pixels of the pixel unit includes: calculating the maximum grayscale value differences according to a formula of $\Delta n=\max(Q\ n(m))$; wherein m represents a type of sub-pixel, n represents a number of grayscale value difference of the sub-pixel, $n \leq i-1$, $\Delta n(m)$ represents the grayscale value difference captured between a sub-pixel of one of the pixel units and the corresponding sub-pixel of another pixel unit.

Further, the grayscale difference threshold is adjustable.

Further, each of the pixel units includes four sub-pixels, the four sub-pixels are a red sub-pixel, a green sub-pixel, a blue sub-pixel, and a white sub-pixel, respectively.

Further, one loop unit includes four pixel units, and the step of capturing grayscale value difference between any sub-pixel of one of the pixel units and the corresponding sub-pixel of another one of the pixel units, and capturing a maximum grayscale value difference from all of the sub-pixels of the pixel unit is to capture a grayscale value difference between a sub-pixel of one of the pixel units and the corresponding sub-pixel of another pixel unit, to capture the maximum grayscale value differences Δ1, Δ2, and Δ3 in all sub-pixels of the pixel unit, and to compare all the maximum grayscale value differences Δ1, Δ2, and Δ3 respectively with the grayscale difference threshold Δth to obtain corresponding comparison results; wherein the comparison results includes:

a first result: $\Delta 1<\Delta th$, $\Delta 2<\Delta th$, $\Delta 3<\Delta th$;

a second result: $\Delta 1\geq\Delta th$, $\Delta 2\geq\Delta th$, $\Delta 3\geq\Delta th$;

a third result: $\Delta 1\geq\Delta th$, $\Delta 2\geq\Delta th$, $\Delta 3<\Delta th$;

a fourth result: $\Delta 1\geq\Delta th$, $\Delta 2<\Delta th$, $\Delta 3\geq\Delta th$;

a fifth result: $\Delta 1<\Delta th$, $\Delta 2\geq\Delta th$, $3\geq\Delta th$;

a sixth result: $\Delta 1\geq\Delta th$, $\Delta 2<\Delta th$, $\Delta 3<\Delta th$;

a seventh result: $\Delta 1<\Delta th$, $\Delta 2\geq\Delta th$, $\Delta 3<\Delta th$; and an eighth result: $\Delta 1<\Delta th$, $2<\Delta th$, $\Delta 3\geq\Delta th$;

wherein Δ1 represents a maximum grayscale value difference of the grayscale value difference of all the sub-pixels between the first pixel unit and the second pixel unit in the four pixel units of one loop unit, Δ2 represents a maximum grayscale value difference of the grayscale value difference of all the sub-pixels between the first pixel unit and the third pixel unit in the four pixel units of the one loop unit, Δ3 represents a maximum grayscale value difference of the grayscale value difference of all the sub-pixels between the first pixel unit and the fourth pixel unit in the four pixel units of the one loop unit, Δth represents the grayscale difference threshold.

Further, the pixel patterns respectively corresponding to the first result to the eighth result include:

a first pattern: (max(G1,G2),max(G2,G3),max(G3,G4));
a second pattern: (G1,f(G2,G3),f(G3,G4));
a third pattern: (G1,f(G2,G3),G4);
a fourth pattern: (G1,G2,f(G3,G4));
a fifth pattern: (G1,G2,max(G3,G4));
a sixth pattern: (G1,G2,f(G3,G4));
a seventh pattern: (f(G1,G2),G3,G4); and
an eighth pattern: (f(G1,G2),f(G2,G3),G4);

wherein f(a,b)=a*ra1+b*ra2, a and b represent the grayscale value of two adjacent pixels, weight ra1=0.5+0.5*(a−b)/255, and weight ra2=0.5+0.5*(b−a)/255; G1, G2, G3, and G4 respectively represent the grayscale value of the first sub-pixel, the second sub-pixel, the third sub-pixel, and the fourth sub-pixel of the pixel unit.

To achieve another object, the present disclosure provides a display device, the display device includes an image capture unit, a grayscale value capture unit, a grayscale value difference calculating unit, a grayscale difference threshold setting unit, and a pixel pattern output unit. The image capture unit is configured to capture original image data, wherein the original image data includes pixel units arranged in an array, each of the pixel units has i sub-pixels, and every i pixel units form a loop unit. The grayscale value capture unit includes an input end connected to an output end of the image capture unit, and is configured to capture a grayscale value of a sub-pixel in each of the pixel units in one loop unit. The grayscale value difference calculating unit includes an input end connected to an output end of the grayscale value capture unit, and is configured to capture a grayscale value difference between any sub-pixel of one of the pixel units and the corresponding sub-pixel of another one of the pixel units and capture a maximum grayscale value difference from all of the sub-pixels of the pixel unit. The grayscale difference threshold setting unit is configured to define a grayscale difference threshold. The pixel pattern output unit includes an input end connected to an output of the grayscale value capture unit and the grayscale difference threshold setting unit, wherein all the maximum grayscale value differences are respectively compared with the grayscale difference threshold in a loop unit to obtain corresponding comparison results in one loop unit, and each of the comparison results corresponds to a pixel pattern.

Further, the display device further includes a storage unit connected to the image capture unit, the grayscale value capture unit, the grayscale value difference calculating unit, the grayscale difference threshold setting unit, and the pixel pattern output unit, wherein the storage unit is configured to store the grayscale value of the sub-pixel in the pixel unit, the maximum grayscale value difference of all the sub-pixels, the grayscale difference threshold, and the comparison results.

Further, the image capture unit includes an input unit and a conversion unit. The input unit is configured to input image data of a pixel unit having (i−1) sub-pixels. The conversion unit includes an input end connected to an output end of the input unit and is configured to convert the image data of a pixel unit having (i−1) sub-pixels into image data of a pixel unit having i sub-pixels to capture the original image data.

Advantageous Effects of Invention

The present disclosure has the beneficial effects: the present disclosure provides a display device and a display method thereof. By detecting the input images, the vertical line feature information of the images is obtained. Weighted weight calculations managing different line types are correspondingly added, therefore, the color aliasing may be effectively avoided, and image features may be restored to the utmost.

Figure 1:
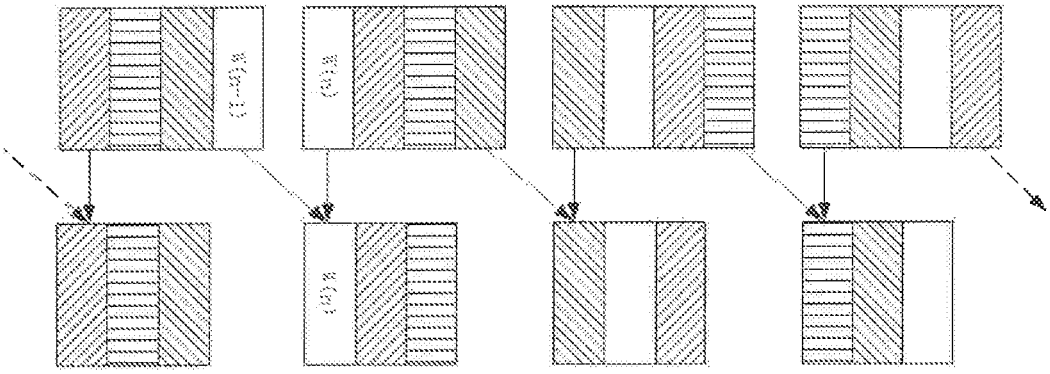
FIG. 1 is a schematic view of a sub-pixel sharing of sub-pixel arrangement of a conventional RGBW strip display device.

1 image capture unit, 2 grayscale value capture unit, 3 grayscale value difference calculating unit, 4 grayscale difference threshold setting unit, 5 pixel pattern output unit, 6 storage unit, 11 input unit, 12 conversion unit, 100 display device.

DETAILED DESCRIPTION OF PREFERRED EMBODIMENTS

The preferred embodiments of the present disclosure will be described in detail below with reference to the drawings, and the technical contents of the present disclosure will be fully described by those skilled in the art. The present disclosure can be implemented by way of example to make the technical content of the present disclosure clearer, and to make it easier for those skilled in the art to understand how to implement the invention. However, the present disclosure may be embodied in many different forms of embodiments, and the scope of the present disclosure is not limited to the embodiments described herein. The description of the embodiments below is not intended to limit the scope of the present disclosure.

In the description of the present disclosure, it is to be understood that terms such as "central", "upper", "lower", "front", "rear", "left", "right", "vertical", "horizontal", "top", "bottom", "inner", "outer", etc. should be construed to refer to the orientation or position as shown in the drawings under discussion. The directional terms used herein are used to explain and explain the present disclosure, and are not intended to limit the scope of the present disclosure.

In the drawings, structurally identical components are denoted by the same reference numerals, and structural or functionally similar components are denoted by like reference numerals. Moreover, the size and thickness of each component shown in the drawings are arbitrarily shown for ease of understanding and description, and the present disclosure does not limit the size and thickness of each component.

When a component is described as "on" another component, the component can be placed directly on the other component; an intermediate component can also be present. The component is placed on the intermediate component and the intermediate component is placed on another component. When a component is described as "installed" or "connected" to another component, they may be understood to be "installed" or "connected" directly, or one component is "mounted" or "connected" to another component through an intermediate component.

Figure 2:
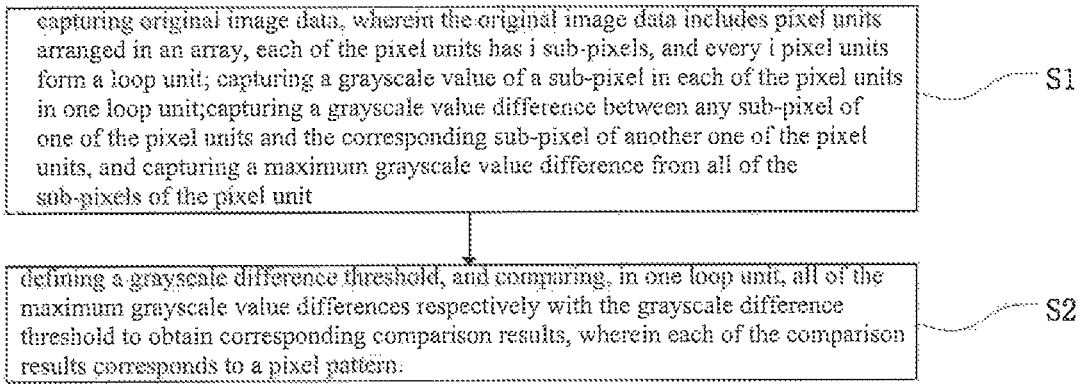
FIG. 2 is a flowchart of a display method of a display device according to an embodiment of the present disclosure.

Referring to FIG. 2, a flowchart of a display method of a display device according to an embodiment of the present disclosure is illustrated. The display method includes:

S1, capturing original image data, wherein the original image data includes pixel units arranged in an array, each of the pixel units has i sub-pixels, and every i pixel units form a loop unit; capturing a grayscale value of a sub-pixel in each of the pixel units in one loop unit; capturing a grayscale value difference between any sub-pixel of one of the pixel units and the corresponding sub-pixel of another one of the pixel units, and capturing a maximum grayscale value difference from all of the sub-pixels of the pixel unit; and S2, defining a grayscale difference threshold, and comparing, in one loop unit, all of the maximum grayscale value differences respectively with the grayscale difference threshold to obtain corresponding comparison results, wherein each of the comparison results corresponds to a pixel pattern.

In the embodiment, the grayscale difference threshold is adjustable, wherein the setting manner of the grayscale difference threshold includes manual input. The smaller the grayscale difference threshold is, the clearer the pixel pattern after rendering is.

In the embodiment, i is preferably 4. That is, the sub-pixel is one of a red sub-pixel, a green sub-pixel, a blue sub-pixel, or a white sub-pixel. The red sub-pixel, the green sub-pixel, the blue sub-pixel, and the white sub-pixel corresponding to the RGBW pixel images respectively represent the first sub-pixel, the second sub-pixel, the third sub-pixel and the fourth sub-pixel of the pixel unit. The RGBW pixel images represent the sub-pixels of the pixel unit.

Figure 3:
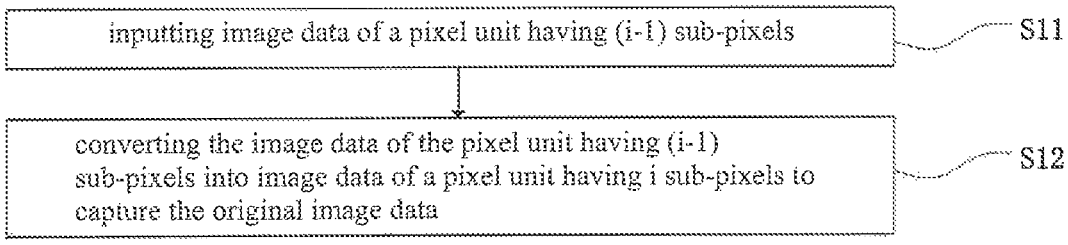
FIG. 3 is a flowchart of a step of capturing original image data according to an embodiment of the present disclosure.

Referring to FIG. 3, the step of capturing original image data includes:

S11, inputting image data of a pixel unit having (i−1) sub-pixels; and

S12, converting the image data of the pixel unit having (i−1) sub-pixels into image data of a pixel unit having i sub-pixels to capture the original image data.

Figure 4:
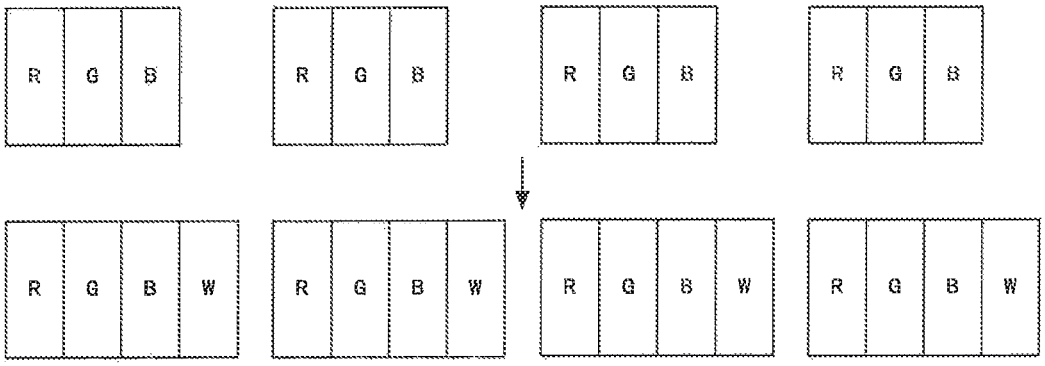
FIG. 4 is a schematic view of the image data conversion in FIG. 3.

Referring to FIG. 4, in the embodiment, i preferably is 4. The image data of the pixel unit having i−1 sub-pixels includes RGB pixel images. R, G, and B of the RGB pixel images respectively represent the first sub-pixel R, the second sub-pixel G, and the third sub-pixel B of the pixel unit. The image data converted into the pixel unit having i sub-pixels includes RGBW pixel images, R, G, B, and W of the RGBW pixel images respectively represent the first sub-pixel R, the second sub-pixel G, the third sub-pixel B, and the fourth sub-pixel W of the pixel unit. That is, each of the pixel units includes four sub-pixels, and the four sub-pixels are a red sub-pixel, a green sub-pixel, a blue sub-pixel and a white sub-pixel. In the embodiment, i preferably is 4. Each 4 of sub-pixels (RGBW) are defined as a basic cyclic unit used as the smallest pixel unit for addressing, sampling, and reconstruction.

In the embodiment, the step of capturing a grayscale value difference between any sub-pixel of one of the pixel units and the corresponding sub-pixel of another one of the pixel units, and capturing a maximum grayscale value difference from all of the sub-pixels of the pixel unit includes: calculating the maximum grayscale value differences according to a formula of $\Delta n=\max(\Delta n(m))$; wherein m represents a type of sub-pixel, n represents a number of grayscale value difference of the sub-pixel, $n \le i-1$, and $\Delta n(m)$ represents the grayscale value difference captured between a sub-pixel of one of the pixel units and the corresponding sub-pixel of another pixel unit.

Specifically, the four pixel units are included in one of the loop units. I preferably is 4. That is, m is 4, indicating that the number of the sub-pixel types is four. The m value may be as follows: m=1, m=2, m=3, or m=4, respectively corresponding to the first sub-pixel, the second sub-pixel, the third sub-pixel, and the fourth sub-pixel of the pixel unit. $n \le 3$. That is, n=1, n=2, and n=3. That is, $\Delta n$ includes $\Delta 1$, $\Delta 2$, and $\Delta 3$. In other words, four pixel units are included in one of the loop units, i.g., a first pixel unit, a second pixel unit, a third pixel unit, and a fourth pixel unit. The first pixel unit is selected as the reference pixel unit, and compared with the sequentially arranged second pixel unit, the third pixel unit, and the fourth pixel unit, respectively to obtain grayscale value differences, $\Delta 1(m)$, $\Delta 2(m)$, and $\Delta 3(m)$ between any sub-pixel in the reference pixel unit and the corresponding sub-pixel of the other pixel unit, and to obtain the maximum grayscale value differences, $\Delta n=\max(\Delta n(m))$, of the grayscale value differences of all the sub-pixels of the pixel unit, wherein n=1, n=2, n=3, so the result of calculating the maximum grayscale value difference by the formula $\Delta n=\max(\Delta n(m))$ is: $\Delta 1=\max(\Delta 1(m))$, $\Delta 2=\max(\Delta 2(m))$, $\Delta 3=\max(\Delta 3(m))$.

Therefore, in each of the loop units, all the maximum grayscale value differences $\Delta 1$, $\Delta 2$, $\Delta 3$ and the grayscale difference threshold $\Delta th$ are respectively compared, the corresponding comparison result includes 8 types, and details as follows:

a first result: $\Delta 1<\Delta th$, $\Delta 2<\Delta th$, $\Delta 3<\Delta th$;
a second result: $\Delta 1\ge\Delta th$, $\Delta 2\ge\Delta th$, $\Delta 3\ge\Delta th$;
a third result: $\Delta 1\ge\Delta th$, $\Delta 2\ge\Delta th$, $\Delta 3<\Delta th$;
a fourth result: $\Delta 1\ge\Delta th$, $\Delta 2<\Delta th$, $\Delta 3\ge\Delta th$;
a fifth result; $\Delta 1<\Delta th$, $\Delta 2\ge\Delta th$, $\Delta 3\ge\Delta th$;
a sixth result: $\Delta 1\ge\Delta th$, $\Delta 2<\Delta th$, $\Delta 3<\Delta th$;
a seventh result: $\Delta 1<\Delta th$, $\Delta 2\ge\Delta th$, $\Delta 3<\Delta th$; and
an eighth result: $\Delta 1<\Delta th$, $\Delta 2<\Delta th$, $\Delta 3\ge\Delta th$;

wherein $\Delta 1$ represents a maximum grayscale value difference of the grayscale value difference of all the sub-pixels between the first pixel unit and the second pixel unit in the four pixel units of one loop unit, $\Delta 2$ represents a maximum grayscale value difference of the grayscale value difference of all the sub-pixels between the first pixel unit and the third pixel unit in the four pixel units of the one loop unit, $\Delta 3$ represents a maximum grayscale value difference of the grayscale value difference of all the sub-pixels between the first pixel unit and the fourth pixel unit in the four pixel units of the one loop unit, $\Delta th$ represents the grayscale difference threshold.

In the embodiment, the pixel patterns respectively corresponding to the first result to the eighth result include:

a first pattern: (max(G1,G2), max(G2, G3), max(G3,G4));
a second pattern: (G1,f(G2,G3),f(G3,G4));
a third pattern: (G1,f(G2,G3),G4);
a fourth pattern: (G1,G2,f(G3,G4));
a fifth pattern: (G1,G2,max(G3,G4));
a sixth pattern: (G1,G2,f(G3,G4));
a seventh pattern: (f(G1,G2),G3,G4); and
an eighth pattern: (f(G1,G2),f(G2,G3),G4);

wherein f(a,b)=a*ra1+b*ra2, a and b represent the grayscale value of two adjacent pixels, weight ra1=0.5+0.5*(a−b)/255, and weight ra2=0.5+0.5*(b−a)/255; G1, G2, G3, and G4 respectively represent the grayscale value of the first sub-pixel, the second sub-pixel, the third sub-pixel, and the fourth sub-pixel of the pixel unit.

In the above manner, the grayscale values of the four sub-pixels of the current sampled pixel can be obtained. In the embodiment, the grayscale value of the primary color sub-pixel of the current original pixel is first calculated, and the weighted weights of the sampled pixels are calculated according to the grayscale values of the molecular pixels in the pre-determined threshold region. The weighted weights are used to weight and sum the primary color pixels of the current original pixel and its adjacent original pixels, thereby obtaining the grayscale value of the primary color sub-pixel of the current sampling pixel. The surrounding pixels are used to improve the resolution. Compared with the existing sampling method, color aliasing of the obtained sample image can be avoided, and a clear sample image can be obtained.

Figure 5:
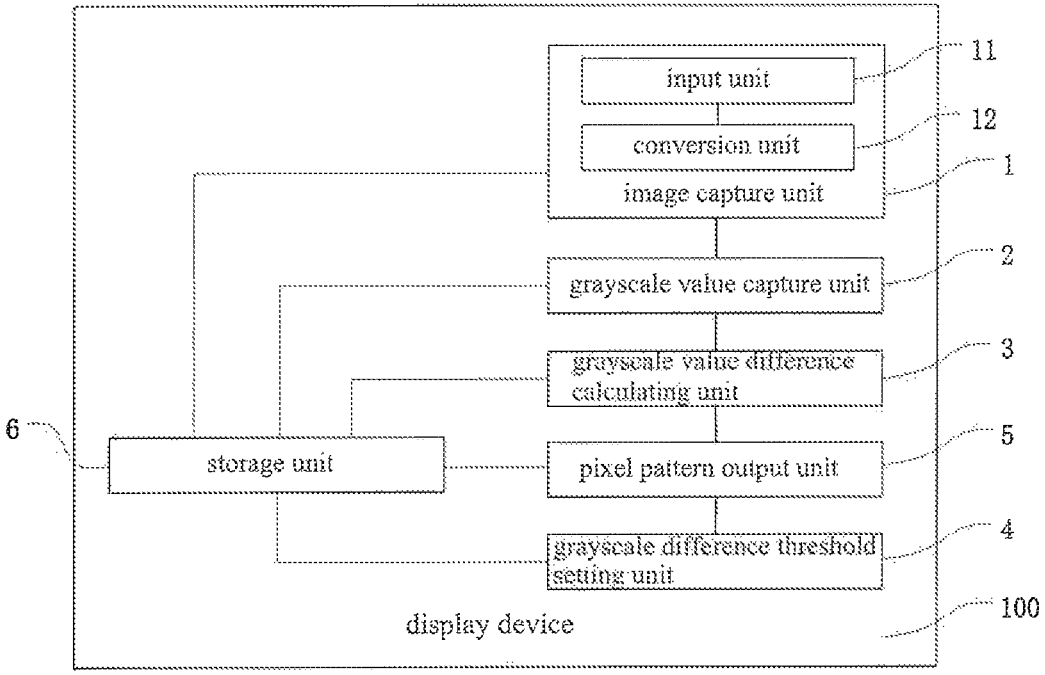
FIG. 5 is a schematic structural view of a display device according to an embodiment of the present disclosure.

Referring to FIG. 5, the present disclosure provides a display device 100, the display device 100 includes an image capture unit 1, a grayscale value capture unit 2, a grayscale value difference calculating unit 3, a grayscale difference threshold setting unit 4, and a pixel pattern output unit 5.

The image capture unit 1, the grayscale value capture unit 2, the grayscale value difference calculating unit 3, the grayscale difference threshold setting unit 4, and the pixel pattern output unit 5 are preferably computers, the computers include storage medium. There are stored a large number of computer executable instructions for executing the display method of the display device. The display device includes a plurality of execution units for executing each of the computer executable instructions, each of which performs a step of the display method.

Specifically, the image capture unit 1 is configured to capture original image data, wherein the original image data includes pixel units arranged in an array, each of the pixel units has i sub-pixels, and every i pixel units form a loop unit. The grayscale value capture unit 2 includes an input end connected to an output end of the image capture unit, and is configured to capture a grayscale value of a sub-pixel in each of the pixel units in one loop unit. The grayscale value difference calculating unit 3 includes an input end connected to an output end of the grayscale value capture unit, and is configured to capture a grayscale value difference between any sub-pixel of one of the pixel units and the corresponding sub-pixel of another one of the pixel units and capture a maximum grayscale value difference from all of the sub-pixels of the pixel unit. The grayscale difference threshold setting unit 4 is configured to define a grayscale difference threshold. The pixel pattern output unit 5 includes an input end connected to an output of the grayscale value capture unit 2 and the grayscale difference threshold setting unit 4, wherein all the maximum grayscale value differences are respectively compared with the grayscale difference threshold in a loop unit to obtain corresponding comparison results in one loop unit, and each of the comparison results corresponds to a pixel pattern.

In the embodiment, the display device further includes a storage unit 6 connected to the image capture unit 1, the grayscale value capture unit 2, the grayscale value difference calculating unit 3, the grayscale difference threshold setting unit 4, and the pixel pattern output unit 5, wherein the storage unit 6 is configured to store the grayscale value of the sub-pixel in the pixel unit, the maximum grayscale value difference of all the sub-pixels, the grayscale difference threshold, and the comparison results.

In the embodiment, the image capture unit 1 includes an input unit 11 and a conversion unit, wherein the input unit 11 is configured to input image data of a pixel unit having (i−1) sub-pixels, and the conversion unit 12 includes an input end connected to an output end of the input unit and is configured to convert the image data of a pixel unit having (i−1) sub-pixels into image data of a pixel unit having i sub-pixels to capture the original image data.

In the above manner, more information of the original image can be retained, which is advantageous for reducing the color aliasing effect, and obtaining a clearer sampled image.

A storage medium stores a computer program. The processor runs the computer program to perform the steps of the display method of the display device.

The present disclosure has the beneficial effects: the present disclosure provides a display device and a display method thereof. By detecting the input images, the vertical line feature information of the images is obtained. Weighted weight calculations managing different line types are correspondingly added, therefore, the color aliasing may be effectively avoided, and image features may be restored to the utmost.

The above description is only a preferred embodiment of the present disclosure, it should be noted that those skilled in the art can also make improvements and retouches without departing from the principles of the present invention. These improvements and retouches should also be considered as protection of the present disclosure.

What is claimed is:

1. A display method of a display device, comprising steps of:

capturing original image data, wherein the original image data includes pixel units arranged in an array, each of the pixel units has i sub-pixels, and every i pixel units form a loop unit, wherein i is 4;

capturing a grayscale value of a sub-pixel in each of the pixel units in one loop unit;

capturing a grayscale value difference between any sub-pixel of one of the pixel units and the corresponding sub-pixel of another one of the pixel units, and capturing a maximum grayscale value difference from all of the sub-pixels of the pixel unit; and defining a grayscale difference threshold, and comparing, in one loop unit, all of the maximum grayscale value differences respectively with the grayscale difference threshold to obtain corresponding comparison results, wherein each of the comparison results corresponds to a pixel pattern.

2. The display method according to claim 1, wherein the step of capturing original image data includes:

inputting image data of a pixel unit having (i-1) sub-pixels; and converting the image data of the pixel unit having (i-1) sub-pixels into image data of a pixel unit having i sub-pixels to capture the original image data.

3. The display method according to claim 1, wherein the step of capturing a grayscale value difference between any sub-pixel of one of the pixel units and the corresponding sub-pixel of another one of the pixel units, and capturing a maximum grayscale value difference from all of the sub-pixels of the pixel unit includes:

calculating the maximum grayscale value differences according to a formula of $\Delta n=\max(\Delta n(m))$;

wherein m represents a type of sub-pixel, n represents a number of grayscale value difference of the sub-pixel, $n \leq i-1$, $\Delta n(m)$ represents the grayscale value difference captured between a sub-pixel of one of the pixel units and the corresponding sub-pixel of another pixel unit.

4. The display method according to claim 1, wherein the grayscale difference threshold is adjustable.

5. The display method according to claim 1, wherein each of the pixel units includes four sub-pixels, the four sub-pixels are a red sub-pixel, a green sub-pixel, a blue sub-pixel, and a white sub-pixel, respectively.

6. The display method according to claim 5, wherein one loop unit includes four pixel units, to capture a grayscale value difference between a sub-pixel of one of the pixel units and the corresponding sub-pixel of another pixel unit, to capture the maximum grayscale value differences Δ1, Δ2, and Δ3 in all sub-pixels of the pixel unit, and to compare all the maximum grayscale value differences Δ1, Δ2, and Δ3 respectively with the grayscale difference threshold Δth to obtain corresponding comparison results; wherein the comparison results includes:

a first result: $\Delta 1<\Delta th$, $\Delta 2<\Delta th$, $\Delta 3<\Delta th$;

a second result: $\Delta 1\geq\Delta th$, $\Delta 2\geq\Delta th$, $\Delta 3\geq\Delta th$;

a third result: $\Delta 1\geq\Delta th$, $\Delta 2\geq\Delta th$, $\Delta 3<\Delta th$;

a fourth result: $\Delta 1\geq\Delta th$, $\Delta 2<\Delta th$, $\Delta 3\geq\Delta th$;

a fifth result: $\Delta 1<\Delta th$, $\Delta 2\geq\Delta th$, $\Delta 3\geq\Delta th$;

a sixth result: $\Delta 1\geq\Delta th$, $\Delta 2<\Delta th$, $\Delta 3<\Delta th$;

a seventh result: $\Delta 1<\Delta th$, $\Delta 2\geq\Delta th$, $\Delta 3<\Delta th$; and an eighth result: $\Delta 1<\Delta th$, $\Delta 2<\Delta th$, $\Delta 3\geq\Delta th$;

wherein Δ1 represents a maximum grayscale value difference of the grayscale value difference of all the sub-pixels between the first pixel unit and the second pixel unit in the four pixel units of one loop unit, Δ2 represents a maximum grayscale value difference of the grayscale value difference of all the sub-pixels between the first pixel unit and the third pixel unit in the four pixel units of the one loop unit, Δ3 represents a maximum grayscale value difference of the grayscale value difference of all the sub-pixels between the first pixel unit and the fourth pixel unit in the four pixel units of the one loop unit, Δth represents the grayscale difference threshold.

7. The display method according to claim 6, wherein the pixel patterns respectively corresponding to the first result to the eighth result include:

a first pattern: (max(G1,G2),max(G2,G3),max(G3,G4));

a second pattern: (G1,f(G2,G3),f(G3,G4));

a third pattern: (G1,f(G2,G3),G4);

a fourth pattern: (G1,G2,f(G3,G4));

a fifth pattern: (G1,G2,max(G3,G4));

a sixth pattern: (G1,G2,f(G3,G4));

a seventh pattern: (f(G1,G2),G3,G4); and an eighth pattern: (f(G1,G2),f(G2,G3),G4);

wherein f(a,b)=a*ra1+b*ra2, a and b represent the grayscale value of two adjacent pixels, weight ra1=0.5+0.5*(a−b)/255, and weight ra2=0.5+0.5*(b−a)/255; G1, G2, G3, and G4 respectively represent the grayscale value of the first sub-pixel, the second sub-pixel, the third sub-pixel, and the fourth sub-pixel of the pixel unit.

8. A display device, comprising:

an image capture unit configured to capture original image data, wherein the original image data includes pixel units arranged in an array, each of the pixel units has i sub-pixels, and every i pixel units form a loop unit, wherein i is 4;

a grayscale value capture unit including an input end connected to an output end of the image capture unit, and configured to capture a grayscale value of a sub-pixel in each of the pixel units in one loop unit;

a grayscale value difference calculating unit including an input end connected to an output end of the grayscale value capture unit, and configured to capture a grayscale value difference between any sub-pixel of one of the pixel units and the corresponding sub-pixel of another one of the pixel units and capture a maximum grayscale value difference from all of the sub-pixels of the pixel unit;

a grayscale difference threshold setting unit configured to define a grayscale difference threshold; and a pixel pattern output unit including an input end connected to an output of the grayscale value capture unit and the grayscale difference threshold setting unit, wherein all the maximum grayscale value differences are respectively compared with the grayscale difference threshold in a loop unit to obtain corresponding comparison results in one loop unit, and each of the comparison results corresponds to a pixel pattern.

9. The display device according to claim 8, wherein the display device further includes a storage unit connected to the image capture unit, the grayscale value capture unit, the grayscale value difference calculating unit, the grayscale difference threshold setting unit, and the pixel pattern output unit, wherein the storage unit is configured to store the grayscale value of the sub-pixel in the pixel unit, the maximum grayscale value difference of all the sub-pixels, the grayscale difference threshold, and the comparison results.

10. The display device according to claim 8, wherein the image capture unit includes:

an input unit configured to input image data of a pixel unit having (i-1) sub-pixels; and a conversion unit including an input end connected to an output end of the input unit and configured to convert the image data of a pixel unit having (i-1) sub-pixels into image data of a pixel unit having i sub-pixels to capture the original image data.

* * * * *